US008151615B2

(12) United States Patent
Sacca'

(10) Patent No.: US 8,151,615 B2
(45) Date of Patent: Apr. 10, 2012

(54) PROFILING MACHINE

(75) Inventor: Luigi Sacca', Ponzano Veneto (IT)

(73) Assignee: STAM S.p.A., Ponzano Veneto (IT)

( * ) Notice: Subject to any disclaimer, the term of this patent is extended or adjusted under 35 U.S.C. 154(b) by 283 days.

(21) Appl. No.: 12/087,010

(22) PCT Filed: Nov. 28, 2006

(86) PCT No.: PCT/EP2006/068991

§ 371 (c)(1),
(2), (4) Date: Jun. 24, 2008

(87) PCT Pub. No.: WO2007/063060

PCT Pub. Date: Jun. 7, 2007

(65) Prior Publication Data

US 2010/0229615 A1 Sep. 16, 2010

(30) Foreign Application Priority Data

Dec. 1, 2005 (IT) ..... VE2005A0059

(51) Int. Cl.
*B21D 5/08* (2006.01)

(52) U.S. Cl. ..... 72/181; 72/178

(58) Field of Classification Search ..... 72/234, 72/178, 181, 179, 180
See application file for complete search history.

(56) References Cited

U.S. PATENT DOCUMENTS

| | | | | |
|---|---|---|---|---|
| 4,787,232 | A | 11/1988 | Hayes | |
| 5,829,294 | A | 11/1998 | Bradbury | |
| 7,004,001 | B2 * | 2/2006 | Barnes | 72/181 |
| 2004/0112103 | A1 | 6/2004 | Gorski | |
| 2004/0163437 | A1 * | 8/2004 | Barnes | 72/181 |

FOREIGN PATENT DOCUMENTS

WO WO 02/43886 6/2002

* cited by examiner

*Primary Examiner* — Teresa Ekiert
*Assistant Examiner* — Mohammad I Yusuf
(74) *Attorney, Agent, or Firm* — Themis Law

(57) ABSTRACT

A profiling machine for forming U, C and Z profiles includes a final profiling unit having a first fixed shoulder disposed inclined to the vertical plane and supporting a plurality of profiling stations each consisting of a pair of profiling rollers, and a second shoulder supporting a plurality of profiling stations each consisting of two pairs of profiling rollers, said second shoulder being hinged on a longitudinal axis to be able to pass from a position for forming Z profiles to a position for forming C and U profiles.

4 Claims, 6 Drawing Sheets

PROFILING MACHINE

FIELD OF THE INVENTION

The present invention relates to a profiling machine.

BACKGROUND OF THE INVENTION

Profiling machines are known comprising a plurality of profiling stations and a motorization unit for said stations.

More particularly, each profiling station comprises two pairs of profiling rollers mounted on two separate shafts supported by two shoulders and rotated in opposite directions. The motorization unit consists of a box containing mutually engaging gearwheels with exit members for coupling to the two shafts of each station.

To be able to work on metal strips of different widths and obtain profiles of different dimensions, profiling machines are known in which the profiling rollers connected to one shoulder are separated from the profiling rollers which face them and are connected to the other shoulder.

To be able to obtain C, U and Z profiles with the same machine, profiling machines have been proposed having a plurality of pairs of profiling rollers hinged to a first shoulder, while to the other shoulder a plurality of sets of three vertically superposed rollers are applied, with the end rollers identical.

This second shoulder is vertically movable under the control of mechanical cylinder- piston units between two positions, in one of which the two rollers of the set of three face the rollers of the pair on the other shoulder specularly (to obtain C or G profiles), while in the other the two rollers of the set of three face the rollers of the other shoulder directly (to obtain Z profiles).

These known machines present however the drawback of a certain working difficulty on varying the dimensional ratio of the profiles (height/width) and in particular in the case of profiles of small width and height, as the profiling rollers may interfere with each other.

Moreover to complete the angles at the bends additional profiling equipment has to be used, so limiting machine flexibility.

SUMMARY OF THE INVENTION

An object of the invention is to provide a profiling machine which forms C, U and Z profiles in a simple and comfortable manner, with a high level of flexibility and designed to increase the dimensional range of the profiles obtained.

This and further objects which will be apparent from the ensuing description are attained according to the invention by a profiling machine as described hereinafter.

BRIEF DESCRIPTION OF THE DRAWINGS

A preferred embodiment of the present invention and two variants thereof are described in detail hereinafter with reference to the accompanying drawings, in which.

DETAILED DESCRIPTION OF EMBODIMENTS OF THE INVENTION

Figure 1:
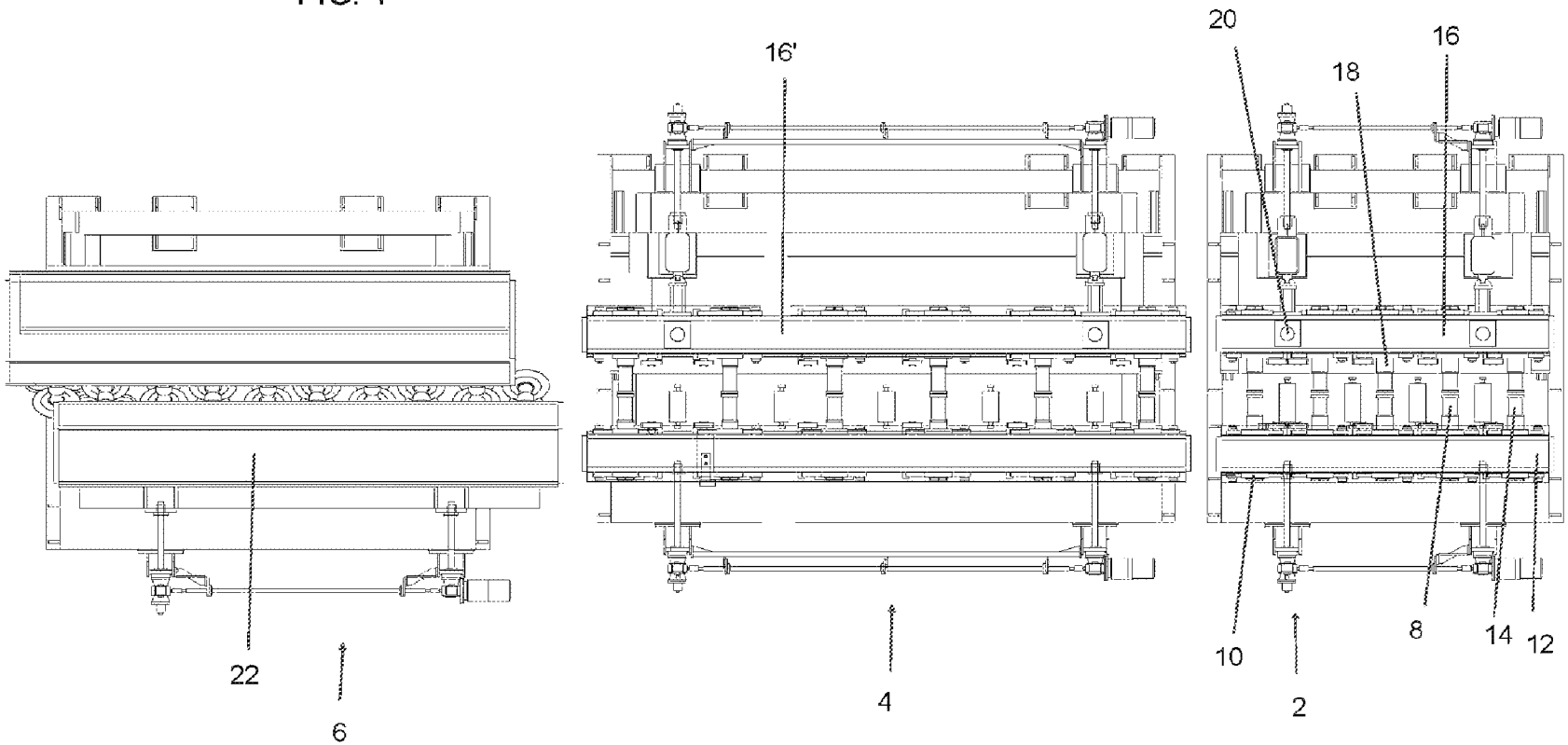
FIG. 1 is a plan view of a profiling machine according to the invention.

As can be seen from the figures, the profiling machine of the invention comprises substantially three units 2, 4, 6 disposed mutually aligned. The unit 2, which is intended to form the flanges of the C and Z profile, comprises a plurality of profiling stations 8 and a motorization unit 10 for said stations. More specifically, the unit 2 comprises a shoulder 12 supporting a plurality of pairs of profiling rollers 14 and a second shoulder 16 carrying applied thereto a plurality of sets of three vertically superposed profiling rollers 18 with their end rollers identical.

This second shoulder is vertically movable between two positions, in one of which two rollers of the three specularly face the rollers of the other shoulder, whereas in the other two rollers of the three face the rollers of the other shoulder directly.

The second shoulder 16 is movable vertically under the control of a cylinder-piston unit system.

The unit 4 which forms the bends giving rise to the parallel sides of the profile is substantially similar to the unit 2, it presents a greater number of profiling stations than the preceding unit, and also presents a shoulder 16' movable vertically under the control of mechanical cylinder-piston units.

The units 2 and 4 are of traditional type with the two shoulders able to be spaced apart, and as such are not further described.

The unit 6 comprises two shoulders 22, 24 for respectively supporting pairs of profiling rollers 28, 28' and sets of three profiling rollers 30, 30', 30". The shoulder 22 which supports the plurality of pairs of profiling rollers is fixed and is disposed at an angle of 45° to the profiling bench, while the shoulder 24 is hinged on a longitudinal hinge 26 to a bracket and can be rotated thereabout by a hydraulic cylinder 29.

The axes of the pairs of rollers 28, 28' are offset from the axes of the sets of three rollers 30, 30', 30".

Figure 2:
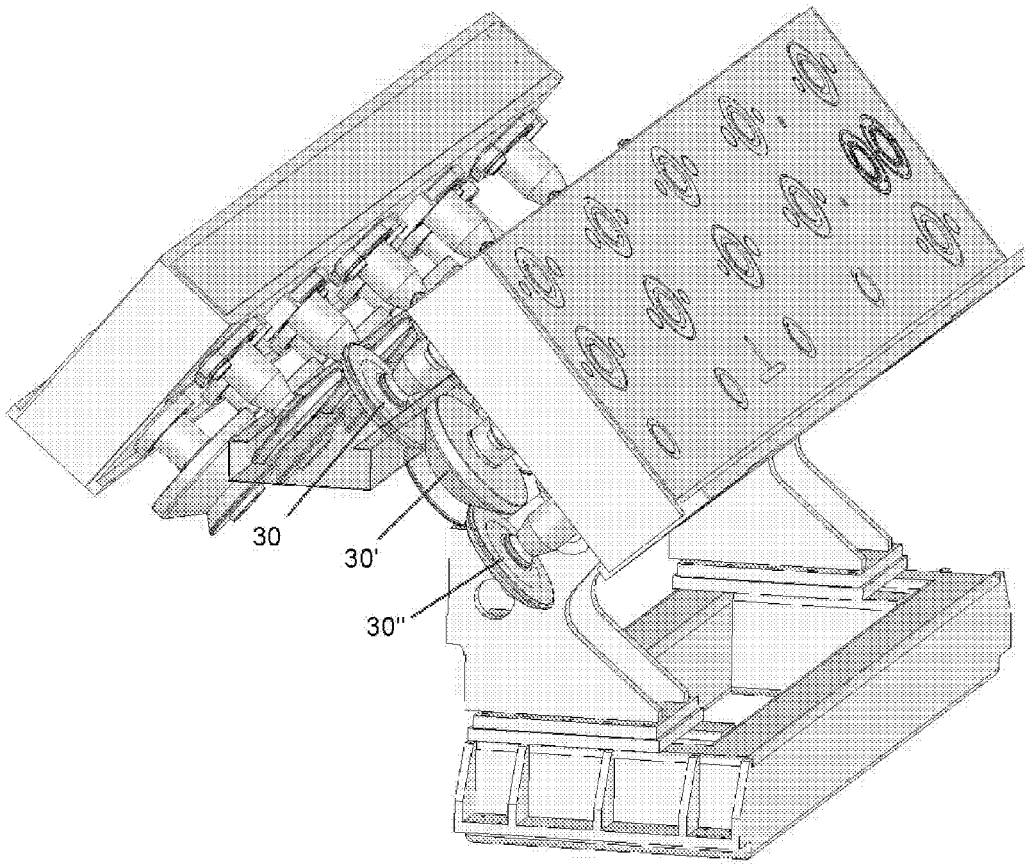
FIG. 2 is a perspective view of the tail unit of the profiling machine in the configuration for forming C profiles.
Figure 3:
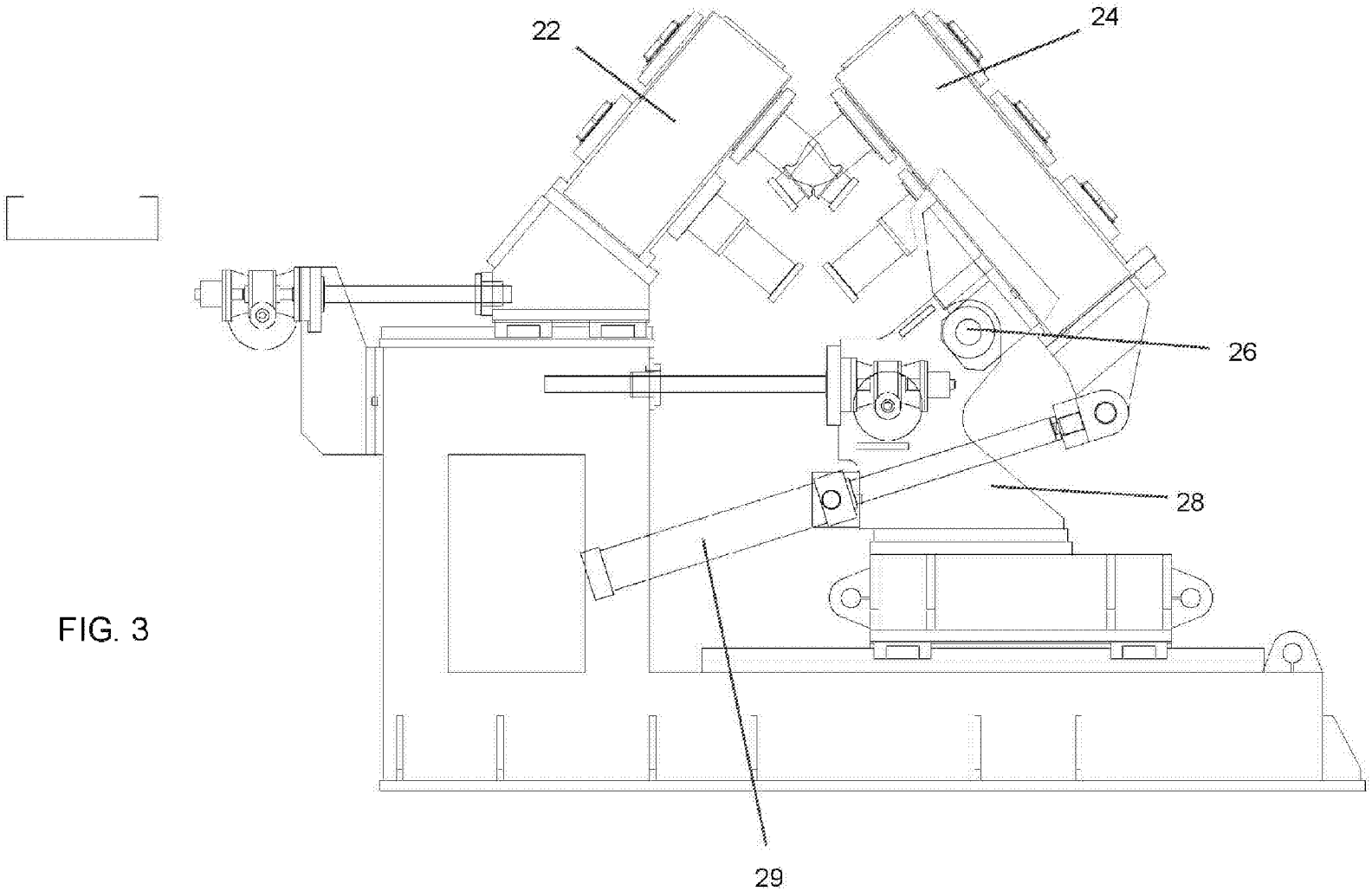
FIG. 3 is a front view thereof.
Figure 4:
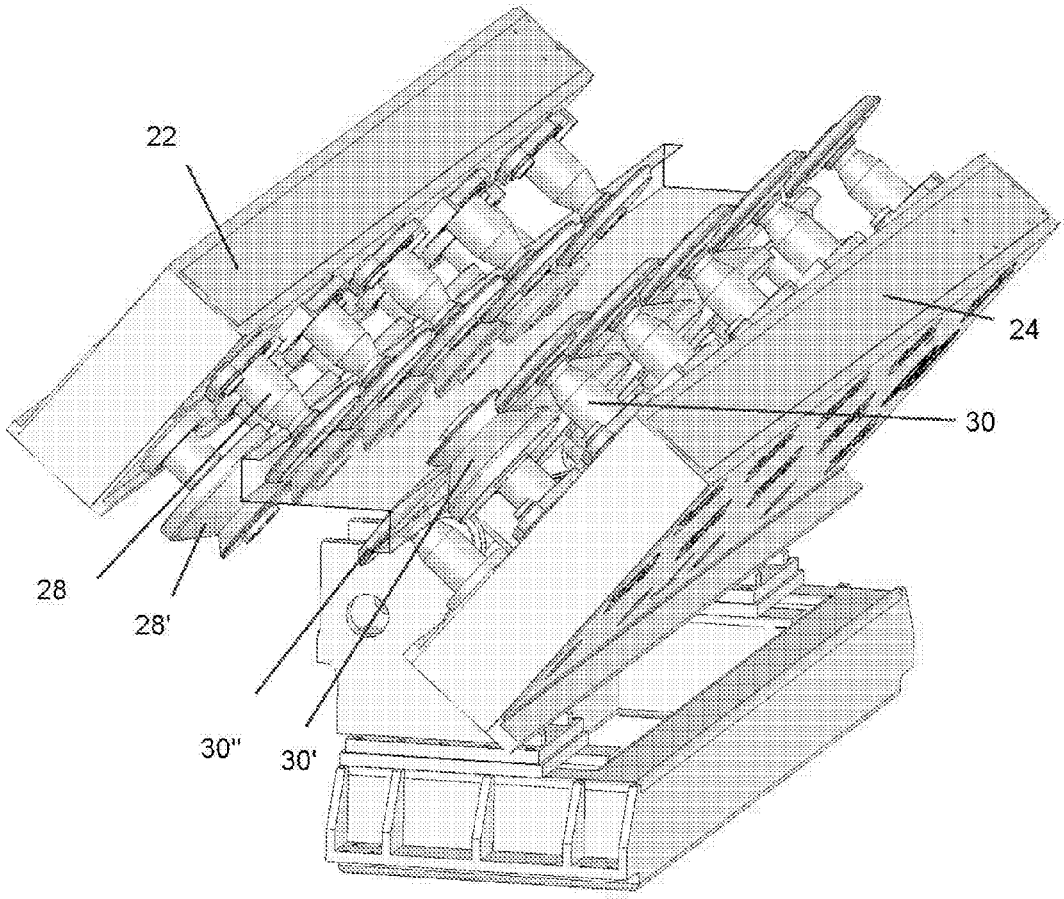
FIG. 4 is a perspective view of the tail unit of the profiling machine in the configuration for forming Z profiles.
Figure 5:
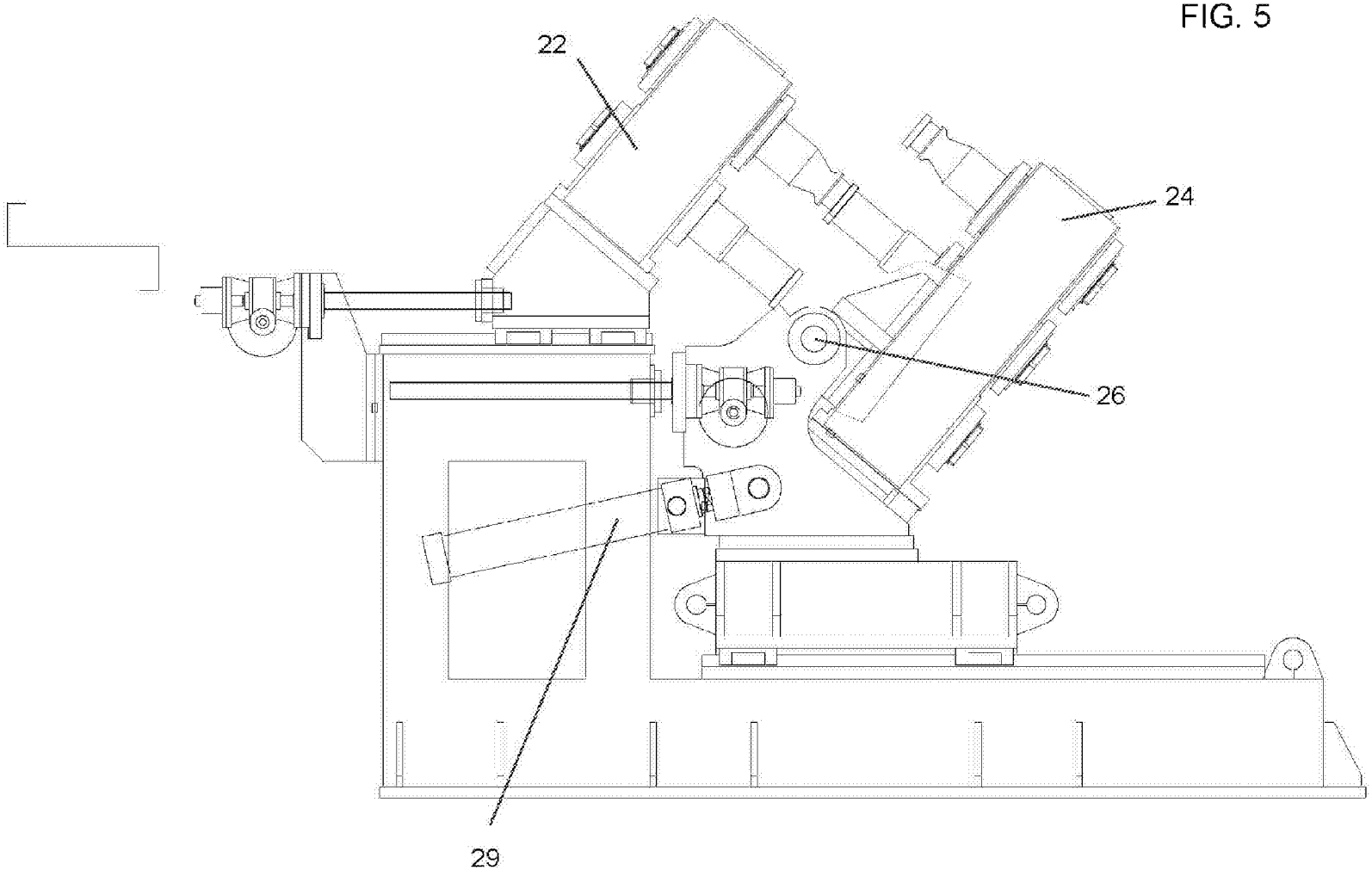
FIG. 5 is a front view thereof.

The shoulder 24 is movable between two end positions, in one of which the planes of the shoulders 22, 24 are mutually parallel (see FIG. 3) and the metal strip is worked by passing it between the central roller 30' and the lower roller 30" of the set of three to obtain Z profiles, while in the other of which the shoulder planes lie at an angle to each other (see FIG. 2) and the metal strip passes through the central roller 30' and the upper roller 30 of each set of three of the movable head to obtain C profiles.

This unit also comprises traditional means for spacing the two shoulders apart and as such are not further described.

The profiling machine of the invention operates traditionally by passing the metal strip between the three profiling units 2, 4 and 6 after these latter have been disposed in the configuration to obtain C or U profiles, or in the configuration to obtain Z profiles.

Figure 6:
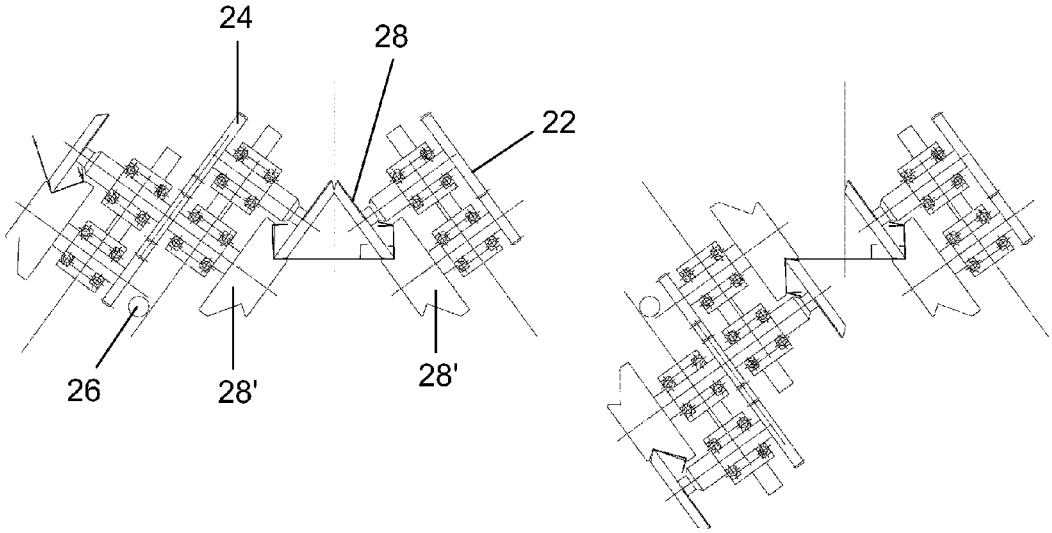
FIG. 6 is a schematic view of a variant of the tail unit.
Figure 7:
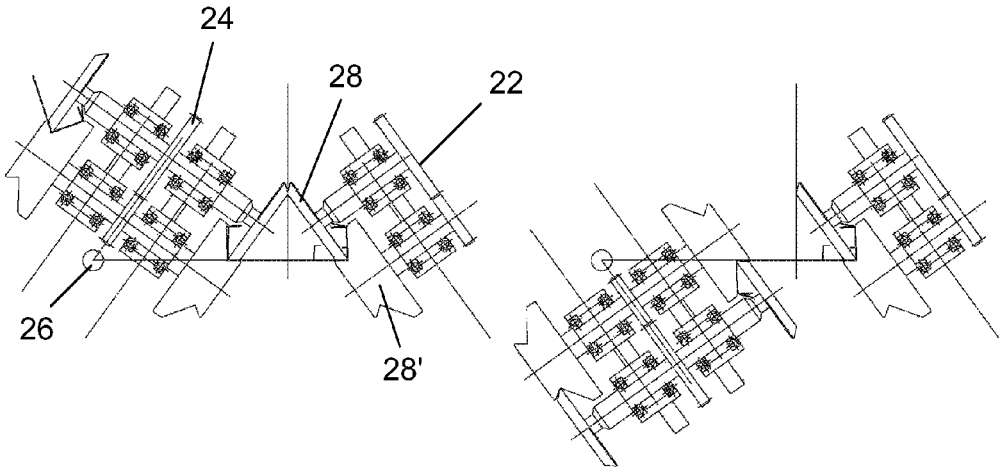
FIG. 7 shows a further variant thereof.

In the embodiments shown in FIGS. 6 and 7 the movable shoulder 24 presents, for each profiling station, two pairs of rollers positioned on opposite sides of the shoulder. In particular in FIG. 6 the rollers of each pair are coaxial to the rollers of the other pair, while in FIG. 7 only one roller of each pair is coaxial with a roller of the other pair.

Again in these embodiments passage from one to the other configuration is achieved by rotating the shoulder 24 about the longitudinal hinge 26.

From the aforegoing it is apparent that because the inclination of the shoulder 24 of the tail unit 6 can be varied and because the profiling heads connected to the shoulder 24 are no longer coaxial with those of the other shoulder, the profiling machine of the invention enables profiles to be obtained of wide dimensional variety, including small-dimension profiles, and possesses a high degree of flexibility without having to use additional profiling equipment to complete the angles at the profile bends.

It should also be noted that by adding suitable profiling heads to the entry side, the profiling machine also enables "sigma" profiles to be produced.

The invention claimed is:

1. A profiling machine for forming U, C and Z profiles, comprising:

an initial profiling unit comprising two parallel initial fixed shoulders, a plurality of initial profiling rollers being supported by the two parallel initial fixed shoulders; and a final profiling unit comprising, a first final fixed shoulder inclined in relation to a vertical plane, a plurality of first profiling stations being supported by the first final fixed shoulder, each first profiling station comprising pairs of first profiling rollers, and a second final shoulder, a plurality of second profiling stations being supported by the second final shoulder, each second profiling station comprising two pairs of second profiling rollers, the first and second final shoulders having opposing planar faces, wherein the second final shoulder is hinged on a longitudinal axis to enable passing from, a first position for forming Z profiles, in which longitudinal planes along the planar faces are mutually parallel, and, for each opposing first and second profiling stations, the first profiling rollers are symmetrical with a first one of the two pairs of the second profiling rollers about a longitudinal axis of the final profiling unit, to a second position for forming C and U profiles, in which longitudinal planes along the planar faces lie at an angle to each other and, for each opposing first and second profiling stations, the first profiling rollers are symmetrical with a second one of the two pairs of second profiling rollers about a vertical longitudinal plane of the final profiling unit, wherein rotational axes of the first profiling rollers are disposed in vertical planes spaced from vertical planes in which rotational axes of the second one of the two pairs of the second profiling rollers are disposed.

2. The profiling machine as claimed in claim 1, wherein the initial profiling unit comprises two initial shoulders each supporting a plurality of initial profiling rollers, a first initial shoulder supporting pairs of superposed initial profiling rollers, and a second initial shoulder supporting sets of three superposed initial profiling rollers having identical end rollers, said second initial shoulder being vertically movable between two end positions, wherein, in each of two end positions, two of the rollers of the sets of three superposed initial profiling are disposed coaxially with one of the pairs of superposed initial profiling rollers.

3. The profiling machine as claimed in claim 1, wherein said first final shoulder supports a plurality of pairs of first profiling rollers, said second final shoulder supporting a plurality of sets of three second profiling rollers.

4. The profiling machine as claimed in claim 1, wherein the first final shoulder is inclined in relation to a horizontal plane by an angle not less than 30°.

* * * * *